US007066161B2

(12) United States Patent
Romero et al.

(10) Patent No.: US 7,066,161 B2
(45) Date of Patent: Jun. 27, 2006

(54) CAPACITIVE DISCHARGE IGNITION SYSTEM

(75) Inventors: John Edward Romero, Thousand Oaks, CA (US); Scott A. Furlong, Henderson, NV (US)

(73) Assignee: Advanced Engine Management, Inc., Hawthorne, CA (US)

( * ) Notice: Subject to any disclaimer, the term of this patent is extended or adjusted under 35 U.S.C. 154(b) by 0 days.

(21) Appl. No.: 10/897,027

(22) Filed: Jul. 23, 2004

(65) Prior Publication Data

US 2005/0016511 A1 Jan. 27, 2005

Related U.S. Application Data

(60) Provisional application No. 60/489,120, filed on Jul. 23, 2003.

(51) Int. Cl.
*F02P 3/06* (2006.01)

(52) U.S. Cl. ..... 123/596; 123/605; 123/653

(58) Field of Classification Search ..... 123/596, 123/605, 643, 653, 640
See application file for complete search history.

(56) References Cited

U.S. PATENT DOCUMENTS

| | | | | |
|---|---|---|---|---|
| 3,605,714 A | | 9/1971 | Hardin et al. | |
| 3,884,207 A | | 5/1975 | Kuehn, III | |
| 4,004,561 A | * | 1/1977 | Thieme | 123/598 |
| 4,154,205 A | * | 5/1979 | Forster | 123/598 |
| 4,366,801 A | | 1/1983 | Endo et al. | |
| 4,369,758 A | | 1/1983 | Endo | |
| 4,418,660 A | | 12/1983 | Endo et al. | |
| 4,441,479 A | | 4/1984 | Endo et al. | |
| 4,445,491 A | | 5/1984 | Ishikawa et al. | |
| 4,455,989 A | | 6/1984 | Endo et al. | |
| 4,690,124 A | | 9/1987 | Higashiyama | |
| 4,739,185 A | | 4/1988 | Lee et al. | |
| 4,825,844 A | | 5/1989 | Fasola | |
| 5,178,120 A | | 1/1993 | Howson et al. | |
| 5,315,982 A | | 5/1994 | Ward et al. | |
| 5,510,952 A | | 4/1996 | Bonavia et al. | |
| 5,513,618 A | | 5/1996 | Rich et al. | |
| 5,531,206 A | * | 7/1996 | Kitson et al. | 123/596 |
| 6,353,293 B1 | * | 3/2002 | Frus et al. | 123/596 |
| 6,837,229 B1 | * | 1/2005 | Mizutani et al. | 123/605 |

* cited by examiner

*Primary Examiner*—Erick Solis
(74) *Attorney, Agent, or Firm*—Berenato, White & Stavish LLC

(57) ABSTRACT

A capacitive discharge ignition (CDI) system for generating ignition sparks in an internal combustion engine comprises a single CDI module including a plurality of charge storage capacitor devices, a corresponding plurality of sets of ignition outputs, at least one charging circuit for charging at least one of the plurality of charge storage capacitor devices, and an ignition controller for selectively and individually controlling each of the plurality of charge storage capacitor devices and the at least one power supply circuit. Each of the plurality of charge storage capacitor devices is operatively coupled to the ignition outputs of one of the plurality of sets of ignition outputs. This allows for the single CDI module to power multiple, independent spark plugs either simultaneous of, immediately prior to or after each other while still delivering full energy to each ignition device.

21 Claims, 7 Drawing Sheets

CAPACITIVE DISCHARGE IGNITION SYSTEM

CROSS-REFERENCE TO RELATED APPLICATION

This Application claims the benefit under 35 U.S.C. 119(e) of U.S. Provisional Application No. 60/489,120 filed Jul. 23, 2003 by John Romero.

BACKGROUND OF THE INVENTION

1. Field of the Invention

The present invention relates to capacitive discharge ignition systems in general and, more particularly, to a capacitive discharge ignition system with a single capacitive discharge ignition module including a plurality of charge storage capacitor devices provided to power a corresponding plurality of sets of ignition outputs.

2. Description of the Prior Art

Conventional ignition systems for internal combustion engines (ICE) have a battery, an ignition coil, a condenser (capacitor), breaker points and a distributor. These systems are known to have a number of disadvantages related to durability and performance. For example, in a typical ignition system, the voltage available to make a spark is at a maximum at idling speeds and decreases as engine speed (or ignition frequency) increases. It would be preferred to have a higher voltage available for the spark at higher firing frequencies. In the case of typical multi-cylinder engines, a high voltage distributor, made of a rotor and a distributor cap, directs the energy to the appropriate spark plug according to the engine crankshaft position through auxiliary air gaps.

The advent of reliable semiconductor device introduced technology which led to the gradual elimination of performance limitation and maintenance problems associated with the mechanical breaker. Transistor-assisted-contact systems (TAC) were introduced where a transistor device relieves the mechanical breaker points of the burden of carrying high current. More recently, mechanical breaker points have been entirely replaced by opto-electronic or inductive sensors coupled to electronic timing and driver circuitry that directly control the coil primary winding current (Transistor Coil Ignition system-TCI). Recently efforts have also been made to eliminate the conventional mechanical rotor system for high voltage ignition pulse distribution, mainly in using multiple coils (one coil per spark plug) or coils with multiple windings associated with high voltage diodes (several spark plugs connected to the same secondary coil winding, plug selection made by using energy polarization).

With further advances in solid state electronics, transistorized electronic ignition systems have become available, and automobile manufacturers now typically provide either inductive or capacitive discharge ignition systems with their products. An inductive discharge ignition system uses a transistor to cut off the current flowing in the primary winding of the ignition coil.

A capacitive discharge ignition (CDI) system typically uses a silicon controlled rectifier to discharge a previously charged capacitor through the primary winding of the ignition coil. As in the conventional ignition system, the voltage applied to the spark plug in an electronic ignition system typically decreases as engine speed increases. A limitation of existing CDI systems is the requirement of a minimum recharge time (typically 0.5 to 2 ms) that must be allowed to ensure that any subsequent discharging of the ignition delivers the full energy. Some of the known CDI systems are disclosed in the following U.S. Pat. Nos. each of which is incorporated herein by reference: 3,605,714; 3,884,207; 4,366,801; 4,369,758; 4,418,660; 4,441,479; 4,445,491; 4,455,989; 4,690,124; 4,739,185; 4,825,844; 5,163,411; 5,178,120; 5,315, 982; 5,510,952; 5,513,618; 5,654,868.

While known CDI systems, including but not limited to those cited above, have proven to be acceptable for various ICE ignition applications, such devices are nevertheless susceptible to improvements that may enhance their performance and reduce cost. With this in mind, a need exists to overcome these shortcomings of the CDI systems of the prior art and to develop improved CDI system that advances the art.

SUMMARY OF THE INVENTION

A capacitive discharge ignition (CDI) system for generating ignition sparks in an internal combustion engine (ICE) in accordance with the present invention comprises a single CDI module including a plurality of charge storage capacitor devices, a corresponding plurality of sets of ignition outputs, at least one charging circuit for charging at least one of the plurality of charge storage capacitor devices, and an ignition controller for selectively and individually controlling each of the plurality of charge storage capacitor devices and the at least one power supply circuit. Furthermore, each of the plurality of charge storage capacitor devices is operatively coupled to the ignition outputs of one of the plurality of sets of ignition outputs. This allows for the single CDI module to power multiple, independent spark plugs or other ignition initiation devices either simultaneous of, immediately prior to or after each other while still delivering full energy to each ignition device. The CDI system further comprises an engine management controller operating the CDI module and provided to generate ignition trigger input signals.

Preferably, the ignition outputs are in the form of primary windings of corresponding, substantially identical spark plug transformers. It will be appreciated by those skilled in the art that the ignition outputs may be associated with any other ignition initiation devices. Moreover, the spark plug transformer for each cylinder of the ICE includes the primary winding which produces high voltage impulses across a secondary winding in response to discharge current flowing through the primary winding. The high voltage impulses across the secondary winding of the spark plug transformer produces a spark across electrodes of a spark plug to ignite the combustible air-fuel mixture within a corresponding cylinder of the ICE. The primary and secondary windings are wound on a ferromagnetic core. Preferably, the spark plug transformers of all the cylinders of the ICE are substantially identical.

According to the first exemplary embodiment of the present invention, the CDI module comprises first and second charge storage capacitor devices, a first plurality of ignition outputs each operatively coupled to the first charge storage capacitor device, a second plurality of ignition outputs each operatively coupled to the second charge storage capacitor device, and two charging circuits each provided for charging corresponding one of the first and second storage capacitor devices. The CDI module according to the first exemplary embodiment of the present invention further comprises a plurality of ignition drivers each connected to corresponding ignition output. Each of the ignition drivers is selectively and individually controlled by the ignition controller. Preferably, the ignition controller is in the form of a microprocessor. Moreover, each of the ignition drivers includes a switch device provided for causing corresponding one of the first and second charge storage capacitor devices to discharge through one of the ignition drivers.

According to the second exemplary embodiment of the present invention, the CDI module comprises first and second charge storage capacitor devices, a first plurality of ignition outputs each operatively coupled to the first charge storage capacitor device, a second plurality of ignition outputs each operatively coupled to the second charge storage capacitor device, and a single charging circuit provided for charging both the first and second storage capacitor devices.

Therefore, the present invention depicts a novel arrangement of the CDI module for the CDI system comprising multiple internal, independently charged and triggered charge storage capacitor devices for independent discharge triggering. This allows a rapid firing of different ignition outputs without the requirement of a delay to wait for a recharge to take place.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

The preferred embodiment of the present invention will now be described with the reference to accompanying drawings.

Figure 1:
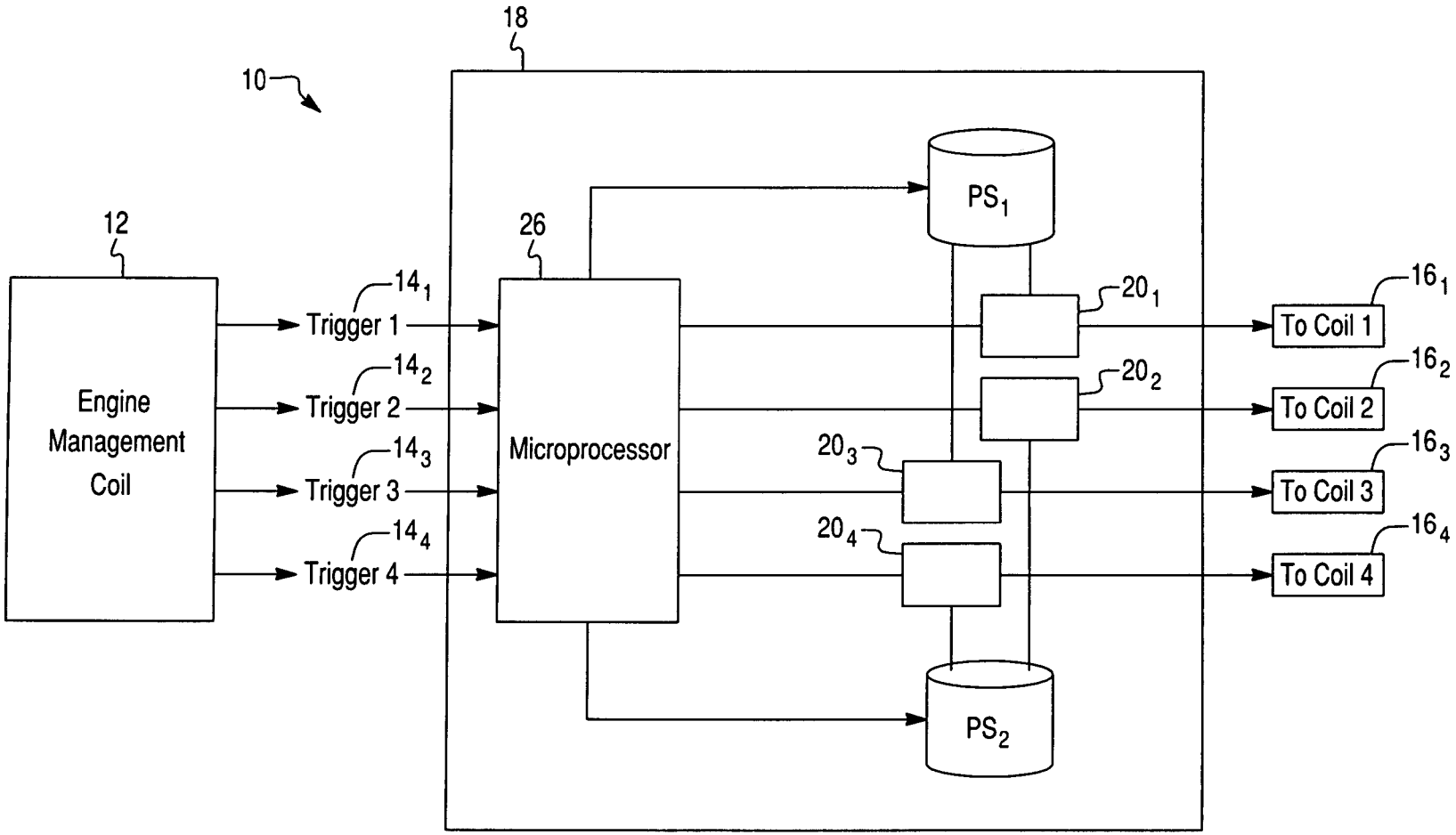
FIG. 1 is a block diagram of a capacitive discharge ignition system in accordance with the first exemplary embodiment of the present invention.

FIG. 1 schematically depicts a capacitive discharge ignition (CDI) system 10 of the first exemplary embodiment of the present invention for a multi-cylinder internal combustion engine (ICE) (not shown). As further illustrated in FIG. 1, the CDI system 10 in accordance with the first exemplary embodiment of the present invention is used for application with the four-cylinder ICE having a firing order 1-2-3-4. It will be appreciated that the CDI system of the present invention may be employed with the ICEs having any number of cylinders, such as 6, 8, 10, etc., and in any configuration, such as in-line, V-shape configuration, opposed-cylinder configuration, etc.

The CDI system 10 comprises a capacitive discharge ignition (CDI) module 18, an ignition trigger device 12 operating the CDI module 18, and a plurality of independent ignition outputs $\mathbf{16}_1$–$\mathbf{16}_4$ each corresponding to one of the four cylinders of the ICE. The CDI module 18 is provided to selectively power the plurality of the ignition outputs $\mathbf{16}_1$–$\mathbf{16}_4$ for generating ignition sparks in the ICE. The ignition trigger device 12 is provided to generate four ignition trigger input signals $\mathbf{14}_1$–$\mathbf{14}_4$. Preferably, the ignition trigger device 12 is in the form of an engine management controller, such as microprocessor. Thus, the CDI system 10 defines four ignition channels 1–4 each coupling the engine management controller 12 with the corresponding one of the ignition outputs $\mathbf{16}_1$–$\mathbf{16}_4$.

Preferably, the ignition outputs $\mathbf{16}_1$–$\mathbf{16}_4$ are in the form of primary windings of corresponding, substantially identical spark plug transformers $\mathbf{15}_n$ (n being the number of cylinders in the ICE). It will be appreciated by those skilled in the art that the ignition outputs $\mathbf{16}_1$–$\mathbf{16}_4$ may be associated with any other ignition initiation devices.

Figure 2:
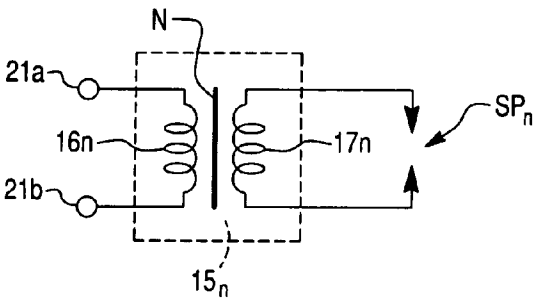
FIG. 2 is a circuit diagram of a spark plug transformer.

The spark plug transformer $\mathbf{15}_n$ for each cylinder of the four-cylinder ICE, illustrated in detail in FIG. 2, includes the primary winding $\mathbf{16}_n$ which produces high voltage impulses across a secondary winding $\mathbf{17}_n$ in response to discharge current flowing through the primary winding $\mathbf{16}_n$. The high voltage impulses across the secondary winding $\mathbf{17}_n$ of the spark plug transformer $\mathbf{15}_n$ produces a spark across electrodes of a spark plug $SP_n$ to ignite the combustible air-fuel mixture within a corresponding cylinder (not shown) of the ICE. The primary and secondary windings $\mathbf{16}_n$ and $\mathbf{17}_n$ are wound on a ferromagnetic core N. The primary winding $\mathbf{16}_n$ has a pair of input terminals 21*a*, 21*b*. Preferably, the spark plug transformers of all the cylinders of the ICE are substantially identical.

Figure 3:
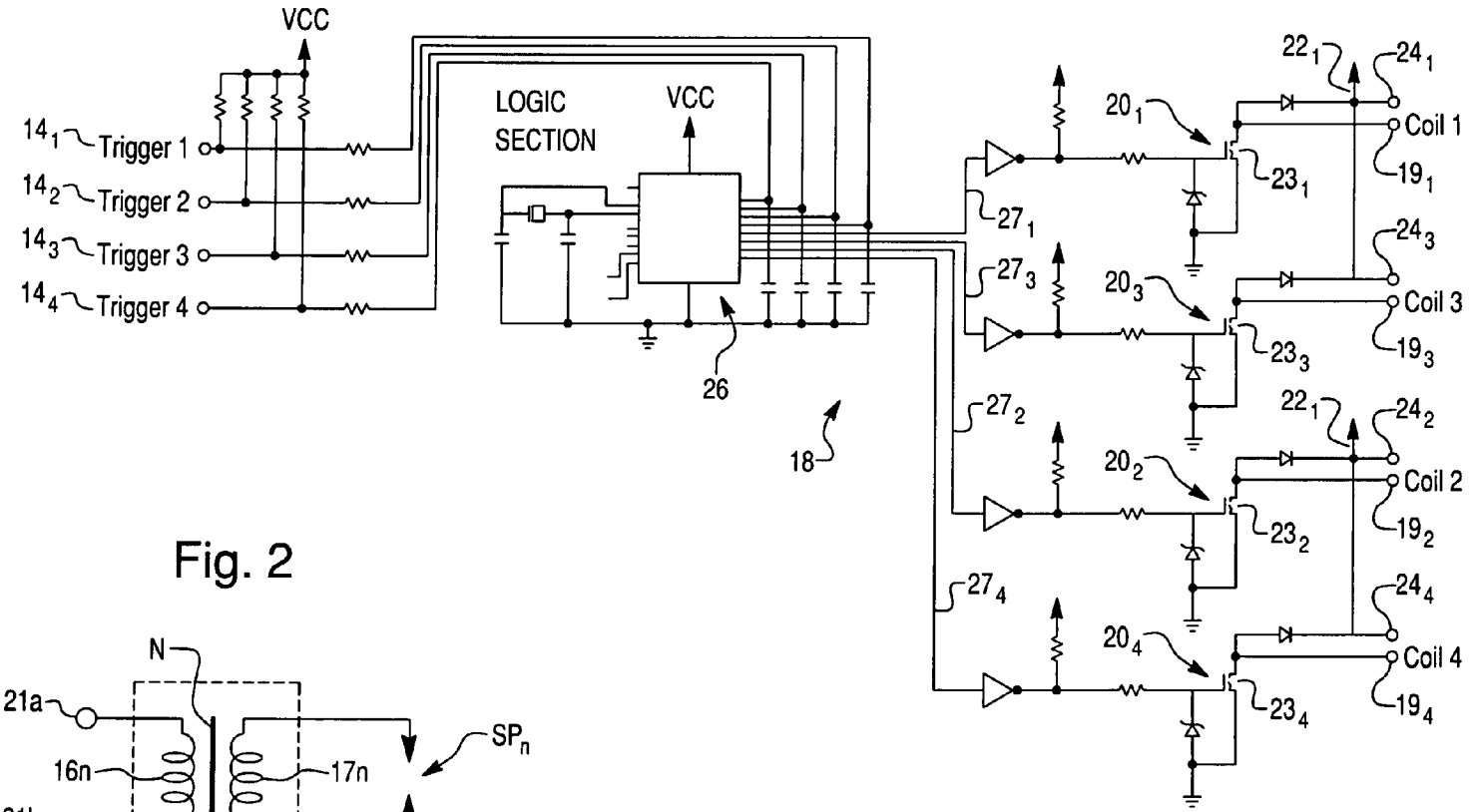
FIG. 3 is a circuit diagram of a capacitive discharge ignition module in accordance with the first exemplary embodiment of the present invention.

The CDI module 18 according to the first exemplary embodiment of the present invention shown in FIGS. 1 and 3, comprises a first power supply device $PS_1$, a second power supply device $PS_2$, ignition drivers $\mathbf{20}_1$–$\mathbf{20}_4$ each connected to corresponding ignition output $\mathbf{16}_1$–$\mathbf{16}_4$, and an ignition controller 26 provided for selectively and individually controlling each of the ignition drivers $\mathbf{20}_1$–$\mathbf{20}_4$ and each of the first and second power supply devices $PS_1$ and $PS_2$. Preferably, the ignition controller 26 is in the form of a microprocessor.

As further illustrated in FIG. 1, the electronic controller 26 of the CDI module 18 is connected to the engine management controller 12 to receive four ignition trigger input signals $\mathbf{14}_1$–$\mathbf{14}_4$ corresponding the number of cylinders of the ICE. The engine management controller 12 sends the ignition trigger input signals $\mathbf{14}_1$–$\mathbf{14}_4$ to the ignition controller 26 for triggering ignition in the corresponding one of the four engine cylinders. It will appreciated by those skilled in the art that trigger input signal timing is typically responsive to the position of an engine crankshaft, crankshaft speed, engine manifold vacuum pressure, etc.

As illustrated in FIG. 1, the first power supply device $PS_1$ is operatively connected to the first and third ignition drivers $\mathbf{20}_1$, and $\mathbf{20}_3$ respectively, while the second power supply device $PS_2$ is operatively connected to the second and forth ignition drivers $\mathbf{20}_2$ and $\mathbf{20}_4$ respectively. Correspondingly, the first power supply device $PS_1$ is provided to power the first and third ignition outputs $\mathbf{16}_1$ and 16for generating ignition sparks in the odd (first and third) cylinders of the ICE, and the second power supply device $PS_2$ is provided to power the second and forth ignition outputs $\mathbf{16}_2$ and $\mathbf{16}_4$ for generating ignition sparks in the even (second and fourth) cylinders. This will allow a rapid firing of different ignition outputs $16_1$–$16_4$ without the requirement of a delay to wait for a recharge to take place. Additionally, with a sufficiently sized power supply device internal to the CDI module 18, very high operating frequencies ( greater than 2 kHz) can be obtained.

Referring further to FIG. 3, the ignition drivers $20_1$–$20_4$ in connection with the electronic controller 26 are illustrated in detail. Preferably, the ignition drivers $20_1$–$20_4$ are structurally substantially identical. Each of the ignition drivers $20_1$–$20_4$ includes a control line $27_n$ (n being the number of cylinders in the ICE) connecting each of the ignition drivers $20_1$–$20_4$ to the ignition controller 26, a switch device $23_n$, two output terminals $19_n$ and $24_n$ and a power supply line $22_i$ (i being the number of power supply devices in the CDI module 18). The output terminals $19_n$, and $24_n$ of the ignition driver $20_n$, are connected to the input terminals 21*a*, 21*b* of the corresponding ignition output $16_n$. However, the power supply line $22_1$, of the ignition drivers $20_1$ and $20_3$ of the first and third cylinders of the ICE is connected to the first power supply device $PS_1$, while the power supply line $22_2$ of the ignition drivers $20_2$ and $20_2$ of the second and fourth cylinders of the ICE is connected to the second power supply device $PS_2$. Preferably, the switch device $23_n$ is a semiconductor switch in the form of a control transistor.

Figure 4:
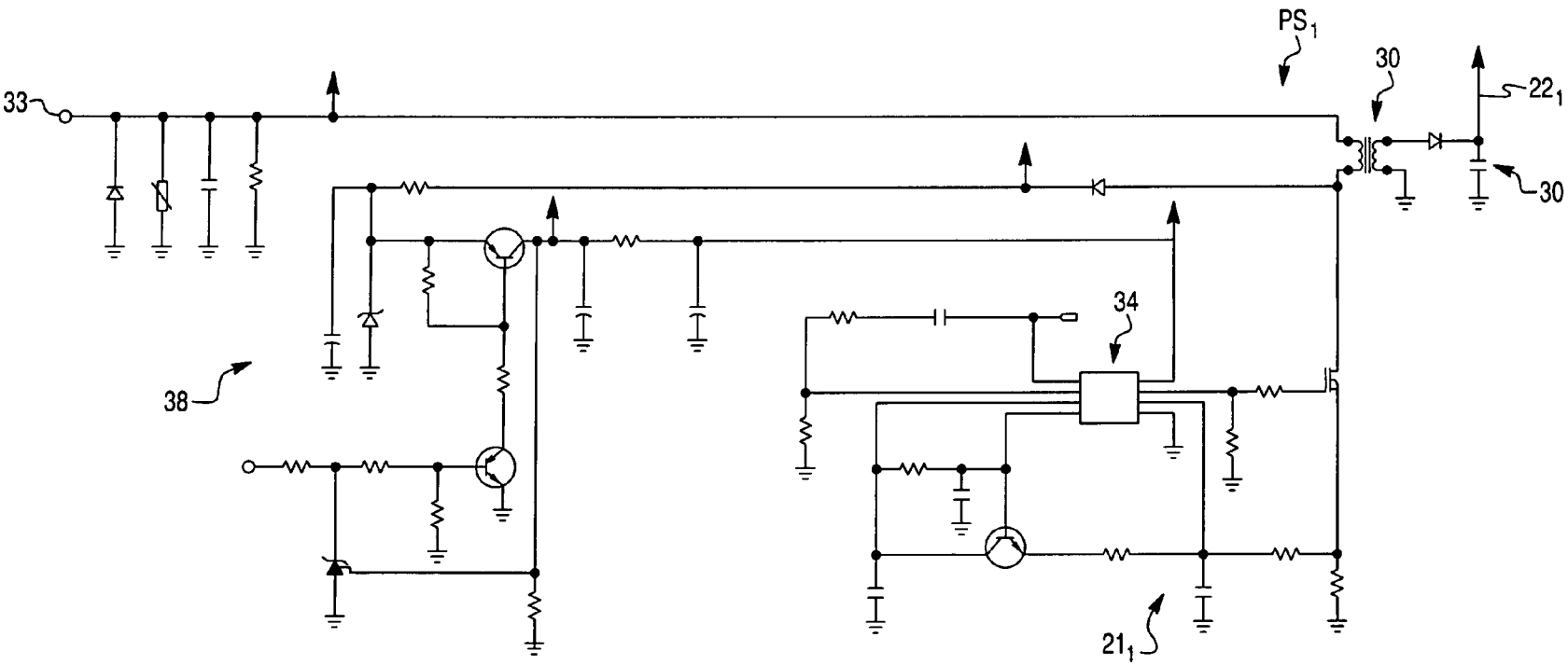
FIG. 4 is a circuit diagram of a first power supply device in accordance with the first exemplary embodiment of the present invention.
Figure 5:
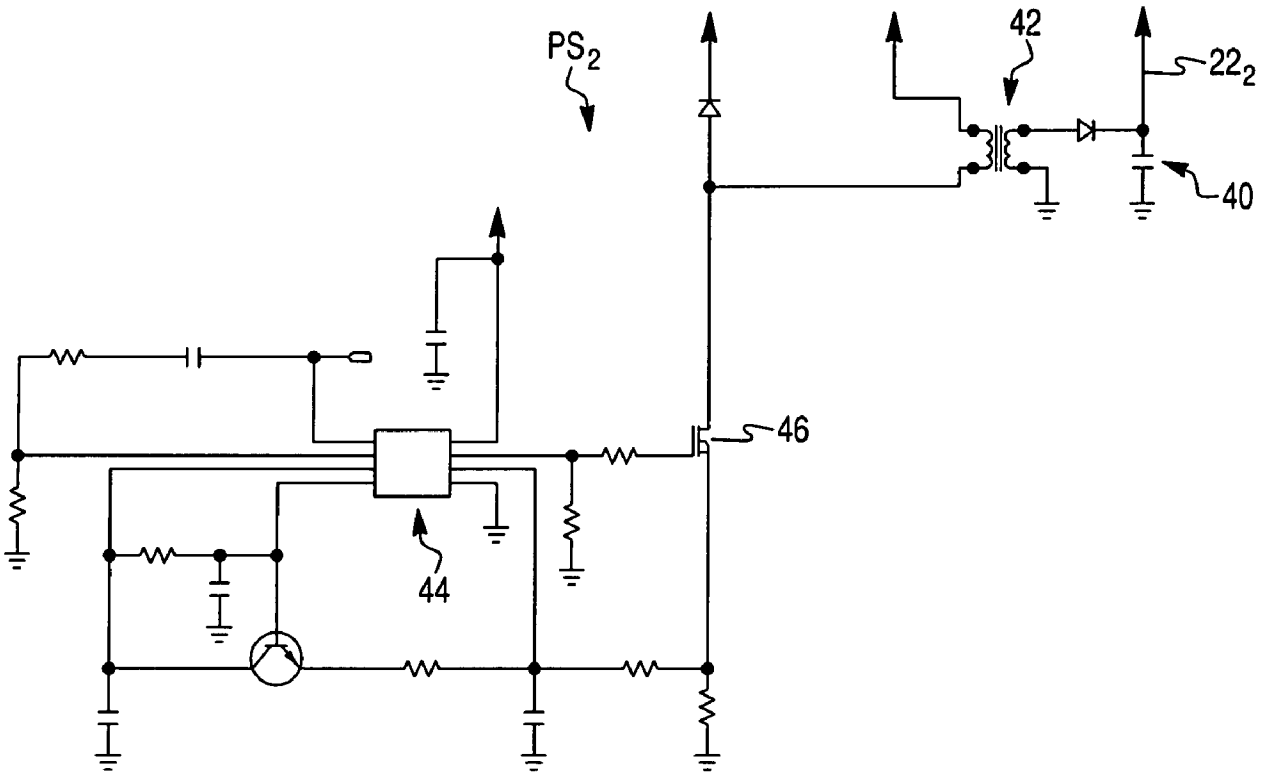
FIG. 5 is a circuit diagram of a second power supply device in accordance with the first exemplary embodiment of the present invention.

The CDI system 10 further includes a motor vehicle battery (not shown), a negative terminal of which is connected to the vehicle earth and a positive terminal of which is connected to the first power supply device $PS_1$ and the second power supply device $PS_2$, as shown in FIGS. 4 and 5.

The first power supply device $PS_1$ illustrated in detail in FIG. 4, comprises a first charge storage capacitor device 30 and a first charging circuit 21, including a voltage transformer 32, a controller 34 and a transistor 36. The power supply line 22, electrically connects the first power supply device $PS_1$ to the he ignition drivers $20_1$ and $20_3$ of the first and third cylinders of the ICE to supply a pulse of current from the first charge storage capacitor device 30 to the ignition outputs $16_1$ and $16_3$. The transformer 32 includes a primary coil connected to the vehicle battery and a secondary coil connected to the first charge storage capacitor device 30. The transformer 32 converts a low DC voltage, e.g., +12 V supplied from the vehicle battery into a high DC voltage, e.g., 500 volts. In accordance with the first exemplary embodiment of the present invention, the first charge storage capacitor device 30 is in the form of a single capacitor C24. It will be appreciated that the first charge storage capacitor device 30 may be in any appropriate form adapted for storing a certain amount of electrical energy, such a bank of capacitors. As further shown in FIG. 4, the first charge storage capacitor device 30 is selectively and repetitively charged by the voltage transformer 32 at a high voltage in order to store enough energy to power the first and third ignition outputs 16, and $16_3$. In turn, the voltage transformer 32 is controlled by the controller 34 through the transistor 36.

The second power supply device $PS_2$ illustrated in detail in FIG. 5, comprises a second charge storage capacitor device 40 and a second charging circuit $21_2$ including a second voltage transformer 42, a second controller 44 and a second transistor 46. The power supply line $22_2$ electrically connects the second power supply device $PS_2$ to the he ignition drivers $20_2$ and $20_4$ of the second and fourth cylinders of the ICE to supply a pulse of current from the second charge storage capacitor device 40 to the second and fourth ignition outputs $16_2$ and $16_4$, respectively. The second transformer 42 is includes a primary coil connected to the vehicle battery and a secondary coil connected to the second charge storage capacitor device 40. Similar to the second transformer 32, the second transformer 42 converts a low DC voltage, e.g., +12 V supplied from the vehicle battery into a high DC voltage, e.g., 500 volts. In accordance with the first exemplary embodiment of the present invention, the second charge storage capacitor device 40 is in the form of a single capacitor C37. It will be appreciated that the second charge storage capacitor device 40 may be in any appropriate form adapted for storing a certain amount of electrical energy, such a bank of capacitors. As further shown in FIG. 5, the second charge storage capacitor device 40 is selectively charged by the second voltage transformer 42 at a high voltage in order to store enough energy to power the second and fourth ignition outputs $16_2$ and $16_4$. In turn, the voltage transformer 42 is controlled by the second controller 44 through the second transistor 46.

As further illustrated in FIG. 4, the first power supply device $PS_1$ also includes a power conditioning circuit 38. Although the power conditioning circuit 38 is incorporated into the first power supply device $PS_1$, it serves both the first power supply device $PS_1$ and the second power supply device $PS_2$.

Thus, the capacitive discharge ignition (CDI) module 18 according to the first exemplary embodiment of the present invention comprises two separate charge storage capacitor devices 30 and 40 each provided to independently and selectively supply pulse of discharge current to the two separate sets (groups) of ignition outputs $16_1$, $16_3$ and $16_2$, $16_4$. In other words, as illustrated in FIGS. 3–5, the first power supply device $PS_1$ is charged through the first transformer 32, stores electrical energy in the first charge storage capacitor device 30 and supplies discharge pulse to the ignition outputs $16_1$ and $16_3$. Similarly, the second power supply device $PS_2$ is charged through the second transformer 42, stores electrical energy in the second charge storage capacitor device 40 and supplies discharge pulse to the ignition outputs $16_2$ and $16_4$. It will be appreciated that the ignition outputs $16_1$ and $16_3$ can be fired independently of the ignition outputs $16_2$ and $16_4$. However, the ignition outputs $16_1$ and $16_3$ must not fire faster than the recharge time of the first charge storage capacitor device 30. Same condition applies for the ignition outputs $16_2$ and $16_4$ and the second charge storage capacitor device 40. The switch device $23_n$ of the each of the ignition drivers $20_1$–$20_4$ is provided for causing the associated charge storage capacitor device to discharge through the corresponding ignition output $16_n$ in response to the ignition trigger input signals of the engine management controller 12.

The grouping of the ignition outputs is determined by the firing order of the cylinders so that the ignition outputs in the first set alternate with the ignition outputs in the second set in the firing sequence. For example, in case of the in-line 4-cylinder engine having the firing order 1-3-4-2, the first and second sets may include the ignition outputs of the cylinders 1, 4 and 2, 3 respectively. Similarly, in case of the V-shaped 6-cylinder engine having the firing order 1-2-5-6-4-3, the first and second sets may include the ignition outputs of the cylinders 1, 4, 5 and 2, 3, 6 respectively. Also similarly, in case of the V-shaped 8-cylinder engine having the firing order 1-6-3-5-4-7-2-8, the first and second sets may include the ignition outputs of the cylinders 1, 2, 3, 4 and 5, 6, 7, 8 respectively.

One of ordinary skill in the art would understand that alternatively, the CDI module of the present invention may include three or more separate charge storage capacitor devices each provided to independently and selectively supply pulse of discharge current to an ignition output of corresponding one of these three or more separate sets of ignition outputs.

Thus, the CDI module 18 of the present invention comprising multiple internal storage capacitor devices allows a rapid firing of different ignition outputs without the requirement of a delay to wait for a recharge to take place before any other channel can fire and independent discharge triggering and recharging. Any/all capacitor devices can discharge at full energy at any time, regardless of the operations of the others. There can be either one power supply section recharging multiple storage capacitors or multiple independent power supply sections enabling very fast, simultaneous recharges. Additionally, with a sufficiently sized power supply device internal to the CDI module 18, very high operating frequencies (greater than 2 kHz) can be obtained.

The capacitive discharge ignition (CDI) system 10, illustrated in FIGS. 1–5, functions as follows. Lets assume that the first ignition trigger input signal $\mathbf{14}_1$ is generated by the engine management controller 12 and sent to the main electronic controller 26 of the CDI module 18. Then, the following takes place:

First, the main electronic controller 26 verifies that the first ignition initiation device, or the ignition channel 1, corresponding to the first cylinder, is not already in the process of firing.

Then, the main electronic controller 26 turns off the first power supply device PSI for the channel 1 being about to be fired to keep it from attempting to recharge the storage capacitor device 30 during the discharge thereof. More specifically, the main electronic controller 26 deactivates the first controller 34 of the first power supply device PSI. This turns off the first transistor 36 which stops the current flow through the first transformer 32. This stops charging the first charge storage capacitor device 30.

Subsequently, the main electronic controller 26 activates the switch device $\mathbf{23}_1$ to discharge the pulse of the electric current from the first storage capacitor device 30 trough the ignition outputs $\mathbf{16}_1$. The resulting current flows through the ignition outputs $\mathbf{16}_1$ (preferably, the primary windings of the spark plug transformer $\mathbf{15}_1$) until the energy stored within the corresponding first storage capacitor device 30 is dissipated. Typically this takes about 125 μs. The main electronic controller 26 holds on the switch device $\mathbf{23}_1$ long enough to discharge the first storage capacitor device 30 and then turns it off.

The spark plug transformers $\mathbf{15}_1$–$\mathbf{15}_4$ in the CDI system 10 according to the first exemplary embodiment of the present invention feature a 100:1 voltage step-up. This creates a voltage potential on the secondary windings $\mathbf{17}_1$–$\mathbf{17}_4$ of the spark plug transformers $\mathbf{15}_1$–$\mathbf{15}_4$ as high as 50,000 volts (or higher, depending on a turn ratios of the spark plug transformer) and is used to trigger a spark across the gap of the spark plugs $SP_1$–$SP_4$.

After the spark event, the main electronic controller 26 reactivates the first power supply device PSI to begin recharging the first storage capacitor device 30 (the capacitor C24). This typically takes about 1 ms, but will vary depending on the capacitors value and charging voltage and current. The first storage capacitor device 30 is now ready to fire again.

At any point in the above procedure, the second power supply device PS2 is still available for discharge since there are two distinct storage capacitor devices 30 and 40. These are continuously charged and only the specific power supply device is deactivated when the ignition output fed by that device is about to be fired. This allows for independent charging and discharging of the storage capacitor devices.

Next, the second ignition trigger input signal $\mathbf{14}_2$ is generated by the engine management controller 12 and sent to the main electronic controller 26 of the CDI module 18. The main electronic controller 26 verifies that the second ignition initiation device, or the ignition channel 2, corresponding to the second cylinder, is not already in the process of firing.

Then, the main electronic controller 26 turns off the second power supply device PS2 for the channel 2 being about to be fired to keep it from attempting to recharge the second storage capacitor device 40 during the discharge thereof. More specifically, the main electronic controller 26 deactivates the second controller 44 of the second power supply device PS2. This turns off the second transistor 46 which stops the current flow through the second transformer 42. This stops charging the second charge storage capacitor device 40.

Subsequently, the main electronic controller 26 activates the second switch device $\mathbf{23}_2$ to discharge the pulse of the electric current from the second storage capacitor device 40 trough the ignition outputs $\mathbf{16}_2$. The resulting current flows through the ignition outputs $\mathbf{16}_2$ (preferably, the primary windings of the spark plug transformer $\mathbf{15}_2$) until the energy stored within the corresponding second storage capacitor device 40 is dissipated. Again, the main electronic controller 26 holds on the second switch device $\mathbf{23}_2$ long enough to discharge the second storage capacitor device 40 and then turns it off. After the spark event, the main electronic controller 26 reactivates the second power supply device PS2 to begin recharging the second storage capacitor device 40 (the capacitor C37). The second storage capacitor device 40 is now ready to fire again.

Next, the third ignition trigger input signal $\mathbf{14}_3$ is generated by the engine management controller 12 and sent to the main electronic controller 26 of the CDI module 18. The main electronic controller 26 verifies that the third ignition initiation device, or the ignition channel 3, corresponding to the third cylinder, is not already in the process of firing.

Then, the main electronic controller 26 turns off the first power supply device PS1 for the channel 3 being about to be fired to keep it from attempting to recharge the first storage capacitor device 30 during the discharge thereof. More specifically, the main electronic controller 26 deactivates the first controller 34 of the first power supply device PS1. This turns off the first transistor 36 which stops the current flow through the first transformer 32. This stops charging the first charge storage capacitor device 30.

Subsequently, the main electronic controller 26 activates the first switch device $\mathbf{23}_1$ to discharge the pulse of the electric current from the first storage capacitor device 30 trough the third ignition outputs $\mathbf{16}_3$. The resulting current flows through the ignition outputs $\mathbf{16}_3$ (preferably, the primary windings of the spark plug transformer $\mathbf{15}_3$) until the energy stored within the corresponding first storage capacitor device 30 is dissipated. Again, the main electronic controller 26 holds on the third switch device $\mathbf{23}_3$ long enough to discharge the first storage capacitor device 30 and then turns it off. After the spark event, the main electronic controller 26 reactivates the first power supply device PS1 to begin recharging the first storage capacitor device 30 (the capacitor C24). The first storage capacitor device 30 is now ready to fire again.

Next, the fourth ignition trigger input signal $\mathbf{14}_4$ is generated by the engine management controller 12 and sent to the main electronic controller 26 of the CDI module 18. The main electronic controller 26 verifies that the fourth ignition initiation device, or the ignition channel 4, corresponding to the fourth cylinder, is not already in the process of firing.

Then, the main electronic controller 26 turns off the second power supply device PS2 for the channel 4 being about to be fired to keep it from attempting to recharge the second storage capacitor device 40 during the discharge thereof. More specifically, the main electronic controller 26 deactivates the second controller 44 of the second power supply device PS2. This turns off the second transistor 46 which stops the current flow through the second transformer 42. This stops charging the second charge storage capacitor device 40.

Subsequently, the main electronic controller 26 activates the fourth switch device (control transistor) $\mathbf{23}_4$ to discharge the pulse of the electric current from the second storage capacitor device 40 trough the fourth ignition outputs $\mathbf{16}_4$. The resulting current flows through the ignition outputs $\mathbf{16}_4$ (preferably, the primary windings of the spark plug transformer $\mathbf{15}_4$) until the energy stored within the corresponding second storage capacitor device 40 is dissipated. Again, the main electronic controller 26 holds on the fourth switch device $\mathbf{23}_4$ long enough to discharge the second storage capacitor device 40 and then turns it off. After the spark event, the main electronic controller 26 reactivates the second power supply device PS2 to begin recharging the second storage capacitor device 40 (the capacitor C37). The second storage capacitor device 40 is now ready to fire again.

After that, the first ignition trigger input signal $\mathbf{14}_4$ is activated again and the above ignition cycle is repeated.

Figure 6:
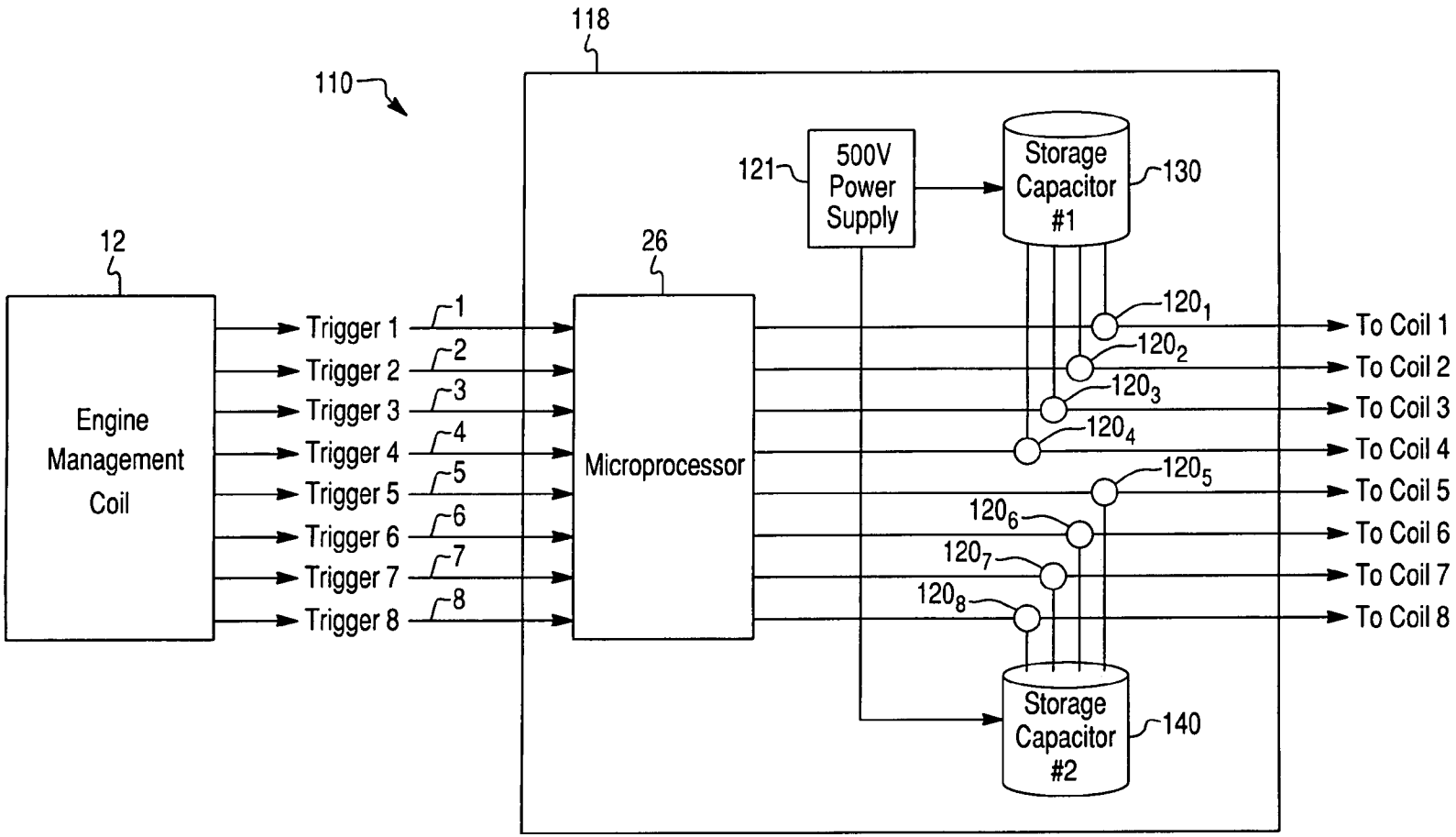
FIG. 6 is a block diagram of a capacitive discharge ignition system in accordance with the second exemplary embodiment of the present invention.
Figure 7:
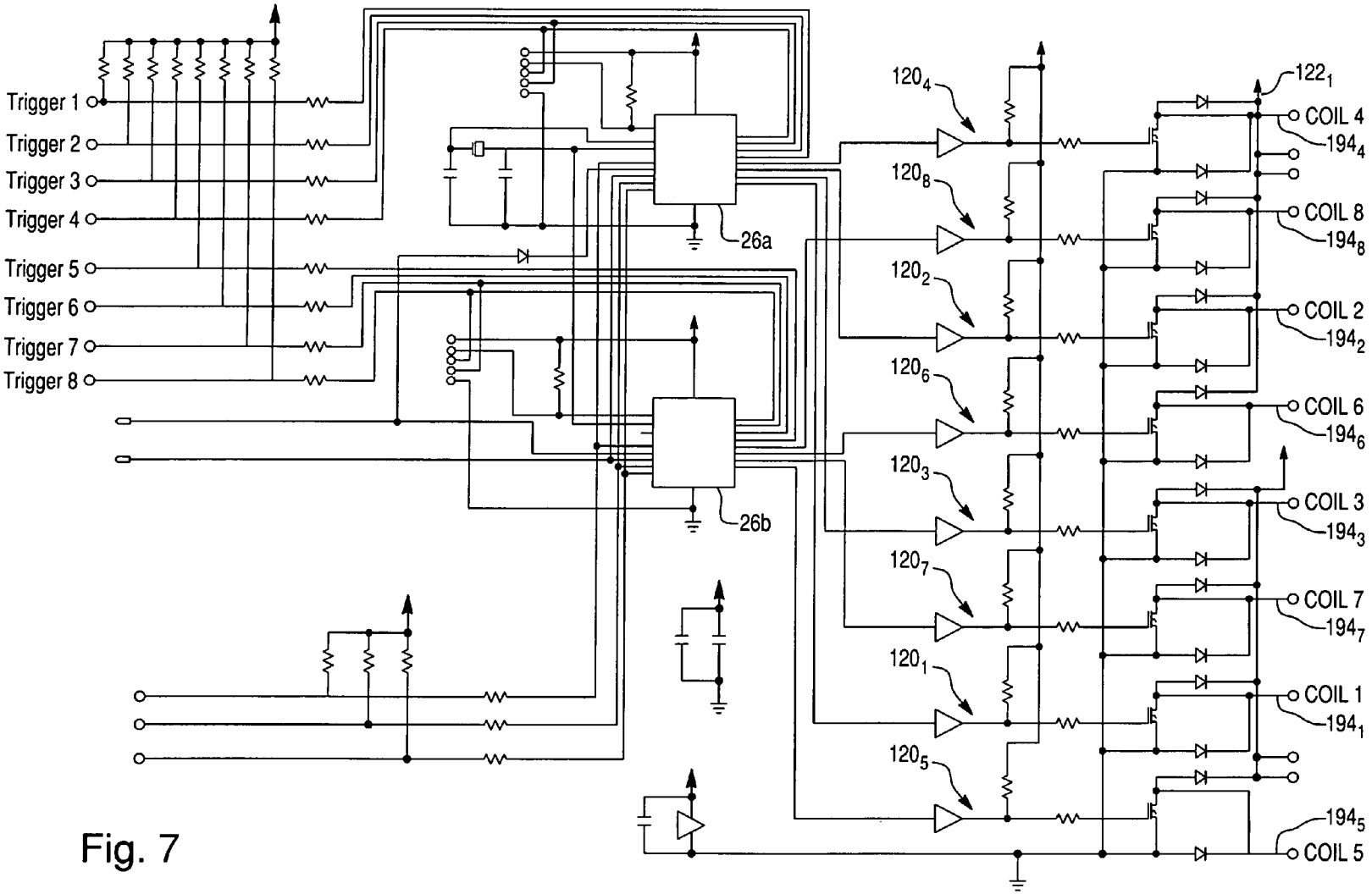
FIG. 7 is a circuit diagram of a capacitive discharge ignition module in accordance with the second exemplary embodiment of the present invention.
Figure 8:
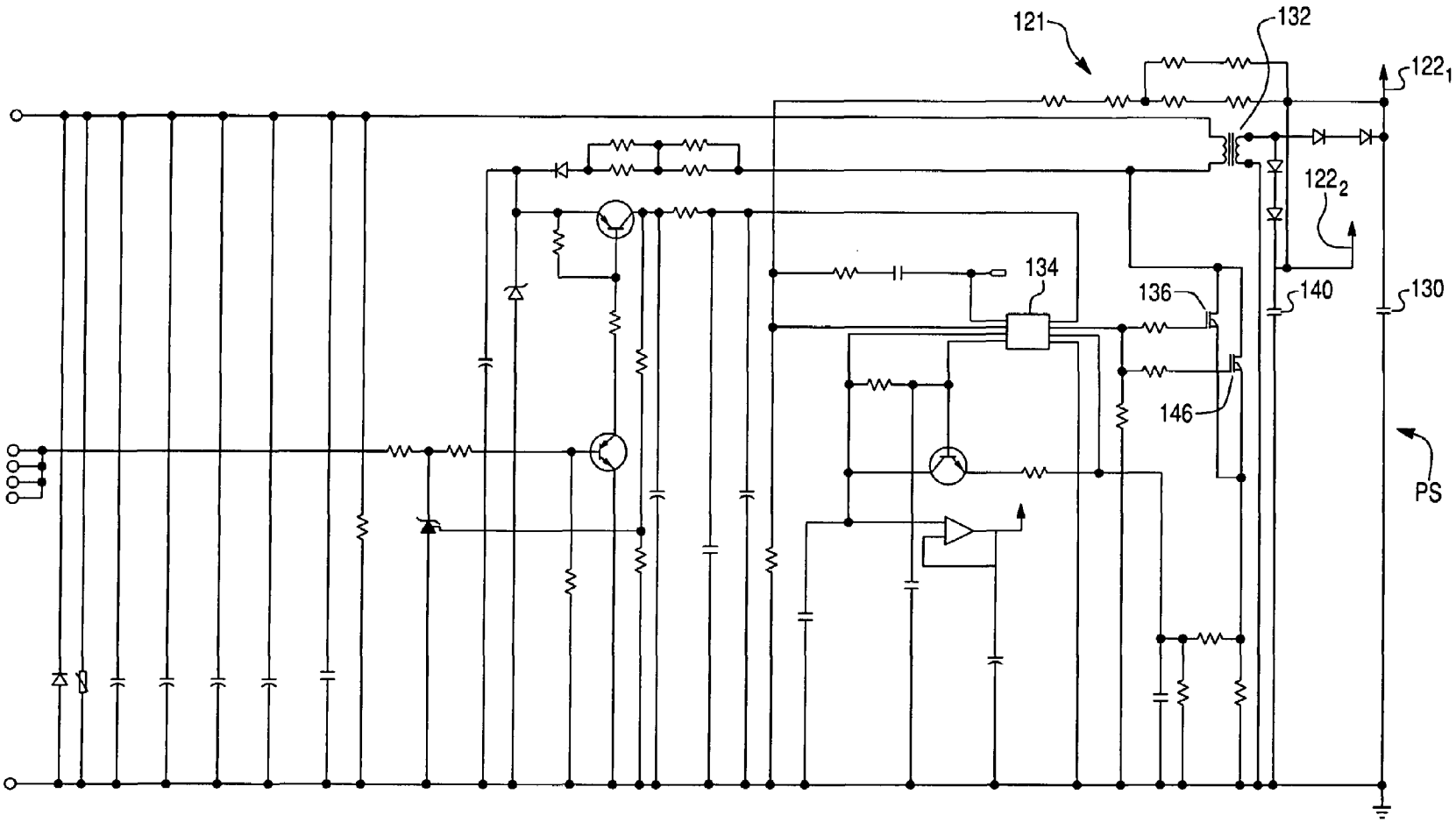
FIG. 8 is a circuit diagram of a power supply device in accordance with the second exemplary embodiment of the present invention.

FIGS. 6–8 show a second exemplary embodiment of the CDI system in accordance with the present invention generally marked with the reference numeral 110. Components that are unchanged from, or function in the same way as in the first exemplary embodiment depicted in FIGS. 1–5 are labeled with the same reference numerals.

FIG. 6 schematically depicts the capacitive discharge ignition (CDI) system 110 of the second exemplary embodiment of the present invention for a multi-cylinder internal combustion engine (ICE) (not shown). As further illustrated in FIG. 6, the CDI system 10 in accordance with the second exemplary embodiment of the present invention is used for application with the eight-cylinder ICE having a firing order 1-6-3-5-4-7-2-8. It will be having any number of cylinders, such as 4, 6, 10, 12, etc., and in any configuration, such as in-line, V-shape configuration, opposed-cylinder configuration, etc.

The CDI system 110 comprises a capacitive discharge ignition (CDI) module 118, an engine management controller 12 operating the CDI module 118, and a plurality of independent ignition outputs in the form of primary windings (ignition coils 1–8) of corresponding, substantially identical spark plug transformers (substantially similar to the spark plug transformer illustrated in detail in FIG. 2. It will be appreciated by those skilled in the art that the ignition outputs of the second exemplary embodiment of the present invention may be associated with any other ignition initiation devices. Each coil 1 through 8 corresponds to one of the eight cylinders of the ICE. The CDI module 118 is provided to selectively power the plurality of the ignition coils 1–8 for generating ignition sparks in the ICE. The engine management controller 12 is provided to generate eight ignition trigger input signals Trigger 1–Trigger 8. Thus, the CDI system 110 defines eight ignition channels 1–8 each coupling the engine management controller 12 with the corresponding one of the ignition coils 1–8.

The CDI module 118 according to the second exemplary embodiment of the present invention shown in FIG. 6, comprises a first storage capacitor device 130, a second storage capacitor device 140, a single power supply device PS provided for recharging both the first and second storage capacitor devices 130 and 140, ignition drivers $\mathbf{120}_1$–$\mathbf{120}_8$ each connected to corresponding ignition coil 1–8, and an electronic controller 26 provided for selectively and individually controlling each of the ignition drivers $\mathbf{120}_1$–$\mathbf{120}_8$.

As further illustrated in FIG. 6, the electronic controller 26 of the CDI module 118 is connected to the engine management controller 12 to receive eight ignition trigger input signals corresponding the number of cylinders of the ICE. The engine management controller 12 sends the ignition trigger signals 1–8 to the electronic controller 26 for triggering ignition in the corresponding one of the eight engine cylinders. It will appreciated by those skilled in the art that trigger input signal timing is typically responsive to the position of an engine crankshaft, crankshaft speed, engine manifold vacuum pressure, etc.

As illustrated in FIG. 6, the first storage capacitor device 130 is operatively connected to the first, second, third and fourth ignition drivers $\mathbf{120}_1$, $\mathbf{120}_2$, $\mathbf{120}_3$ and $\mathbf{120}_4$ respectively, while the second storage capacitor device 140 is operatively connected to the fifth, sixth, seventh and eighth ignition drivers $\mathbf{120}_5$, $\mathbf{120}_6$, $\mathbf{120}_7$ and $\mathbf{120}_8$ respectively. Correspondingly, the first storage capacitor device 130 is provided to power the first, second, third and fourth ignition coils 1–4 for generating ignition sparks in the first four cylinders 1–4 of the ICE, and the second storage capacitor device 140 is provided to power the fifth, sixth, seventh and eighth ignition coils 5–6 for generating ignition sparks in the remaining four cylinders 5–8.

Referring now to FIG. 7, the ignition drivers $\mathbf{120}_1$–$\mathbf{120}_8$ are illustrated in detail. The CDI module 118 shown in FIG. 7 includes two electronic controllers 26*a* and 26*b* defining in combination the electronic controller 26 shown in FIG. 6. The first electronic controller 26*a* receives the ignition trigger input signals Trigger 1–Trigger 4 and is provided to control the ignition drivers $\mathbf{120}_1$–$\mathbf{120}_4$, while the second electronic controller 26*b* receives the ignition trigger input signals Trigger 5–Trigger 6 and is provided to control the ignition drivers $\mathbf{120}_5$–$\mathbf{120}_8$. Preferably, the ignition drivers $\mathbf{120}_1$–$\mathbf{120}_8$ are structurally substantially identical. Each of the ignition drivers $\mathbf{120}_1$–$\mathbf{120}_8$ includes an output terminal $\mathbf{19}_n$ (n being the number of cylinders in the ICE) and a power supply line $\mathbf{122}_i$ (i being the number of storage capacitor devices in the CDI module 118). More specifically, as illustrated in FIG. 7, the ignition drivers $\mathbf{120}_1$–$\mathbf{120}_4$ are connected to a first power supply line $\mathbf{122}_1$, while the he ignition drivers $\mathbf{120}_5$–$\mathbf{120}_8$ are connected to a second power supply line $\mathbf{122}_2$.

The power supply device PS illustrated in detail in FIG. 8, comprises the first charge storage capacitor device 130, the second charge storage capacitor device 140, and a charging circuit 121 including a voltage transformer 132, a controller 134, a first transistor 136, and a second transistor 146. The first transistor 136 controls recharging of the first charge storage capacitor device 130, while the second transistor 146 controls recharging of the second charge storage capacitor device 140. The power supply line $\mathbf{122}_1$ electrically connects the power supply device PS to the he ignition drivers $\mathbf{120}_1$–$\mathbf{120}_4$, and the power supply line $\mathbf{122}_2$electrically connects the power supply device PS to the he ignition drivers $\mathbf{120}_5$–$\mathbf{120}_8$.

The transformer 132 includes a primary coil connected to the vehicle battery and a secondary coil connected to both the first and second charge storage capacitor devices 130 and 140. The transformer 132 converts a low DC voltage, e.g., +12 V supplied from the vehicle battery into a high DC voltage, e.g., 500 volts. In accordance with the second exemplary embodiment of the present invention, the first charge storage capacitor device 130 is in the form of a single capacitor C24, while the second charge storage capacitor device 140 is in the form of a single capacitor C11. It will be appreciated that the charge storage capacitor devices 130 and 140 may be in any appropriate form adapted for storing a certain amount of electrical energy, such a bank of capacitors. As further shown in FIG. 8, the first and second charge storage capacitor devices 130 and 140 are selectively and repetitively charged by the voltage transformer 132 at a high voltage in order to store enough energy to power the ignition coils 1–8. In turn, the voltage transformer 132 is controlled by the controller 134 through the first and second transistors 136 and 146.

The CDI system 110 functions substantially similar to the CDI system 10 according to the first exemplary embodiment of the present invention.

Therefore, the present invention embodies a novel arrangement of the capacitive discharge ignition system including a single CDI module to power multiple, independent spark plugs or other ignition initiation devices either simultaneous of, immediately prior to or after each other while still delivering full energy to each ignition device. The CDI module of the present invention comprises multiple internal storage capacitor devices allowing a rapid firing of different ignition outputs without the requirement of a delay to wait for a recharge to take place before any other channel can fire and independent discharge triggering and recharging. Any/all capacitor devices can discharge at full energy at any time, regardless of the operations of the others. There can be either one power supply device recharging multiple storage capacitors or multiple independent power supply devices enabling very fast, simultaneous recharges. In case only one power supply device (one transformer) is used for charging multiple storage capacitors, the near or simultaneous discharge of the storage capacitor devices would be allowed but limited in the recharge rate of the charge storage capacitor devices.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A capacitive discharge ignition module to selectively power a plurality of independent ignition devices for generating ignition sparks in an internal combustion engine, said capacitive discharge ignition module comprising:

a plurality of charge storage capacitor devices;

a plurality of sets of ignition outputs one each operatively coupled only to a dedicated corresponding one of said charge storage capacitor devices;

at least one charging circuit for charging said plurality of charge storage capacitor devices; and an ignition controller for selectively and individually controlling each of said plurality of charge storage capacitor devices and said at least one power supply circuit.

2. The capacitive discharge ignition module as defined in claim 1, further including a plurality of ignition drivers each operatively coupled to one of said ignition outputs of one of said plurality of sets of ignition outputs, wherein each of said plurality of ignition drivers includes a switch device for causing one of said plurality of charge storage capacitor devices to discharge through the corresponding one of said ignition drivers in response to an ignition trigger input signal generated by an ignition trigger device.

3. The capacitive discharge ignition module as defined in claim 2, wherein said switch device is a semiconductor switch.

4. The capacitive discharge ignition module as defined in claim 1, wherein said at least one charging circuit includes a plurality of charging circuits each provided for charging one of said plurality of charge storage capacitor devices.

5. The capacitive discharge ignition module as defined in claim 1, wherein said at least one charging circuit includes a single charging circuit provided for charging all of said plurality of charge storage capacitor devices.

6. The capacitive discharge ignition module as defined in claim 1, wherein said at least one charging circuit includes a voltage transformer provided for converting a low D.C. voltage to a high D.C. voltage.

7. The capacitive discharge ignition module as defined in claim 1, wherein said plurality of charge storage capacitor devices includes a first charge storage capacitor device and a second charge storage capacitor device; and wherein said corresponding plurality of sets of ignition outputs includes a first set of ignition outputs each operatively coupled to said first storage capacitor device and a second set of ignition outputs each operatively coupled to said second storage capacitor device.

8. The capacitive discharge ignition module as defined in claim 7, wherein said at least one charging circuit includes a first charging circuit provided for charging said first charge storage capacitor device and a second charging circuit provided for charging said second charge storage capacitor device.

9. The capacitive discharge ignition module as defined in claim 7, wherein said at least one charging circuit includes a single charging circuit provided for charging both said first charge storage capacitor device and said second charge storage capacitor device.

10. The capacitive discharge ignition system as defined in claim 1, wherein each of said ignition outputs is in the form of a primary winding of a spark plug transformer further including a secondary winding connected to a spark plug.

11. A capacitive discharge ignition system to selectively power a plurality of independent ignition devices for generating ignition sparks in an internal combustion engine, said capacitive discharge ignition system comprising:

a plurality of charge storage capacitor devices;

a plurality of sets of ignition outputs one each operatively coupled only to a dedicated corresponding one of said charge storage capacitor devices;

at least one charging circuit for charging said plurality of charge storage capacitor devices; and an ignition controller for selectively and individually controlling each of said plurality of charge storage capacitor devices and said at least one power supply circuit.

12. The capacitive discharge ignition system as defined in claim 11, further comprising an ignition trigger device for generating a plurality of ignition trigger input signals in synchronism with the rotation of the engine, each of said plurality of ignition trigger input signals correspond to one of said plurality of said ignition outputs and is provided to cause one of said plurality of charge storage capacitor devices to selectively discharge through one of said ignition outputs of corresponding set of said plurality of sets of ignition outputs.

13. The capacitive discharge ignition system as defined in claim 12, wherein said ignition trigger device is an engine management controller.

14. The capacitive discharge ignition system as defined in claim 11, further including a plurality of ignition drivers each operatively coupled to one of said ignition outputs in one of said plurality of sets of ignition outputs, wherein each of said plurality of ignition drivers includes a switch device for causing one of said plurality of charge storage capacitor devices to discharge through the corresponding one of said ignition drivers in response to an ignition trigger input signal generated by an engine management controller.

15. The capacitive discharge ignition system as defined in claim 14, wherein said switch device is a semiconductor switch.

16. The capacitive discharge ignition system as defined in claim 11, wherein said at least one charging circuit includes a plurality of charging circuits each provided for charging one of said plurality of charge storage capacitor devices.

17. The capacitive discharge ignition system as defined in claim 11, wherein said at least one charging circuit includes a single charging circuit provided for charging all of said plurality of charge storage capacitor devices.

18. The capacitive discharge ignition system as defined in claim 11, wherein said at least one charging circuit includes a voltage transformer provided for converting a low D.C. voltage to a high D.C. voltage.

19. The capacitive discharge ignition system as defined in claim 11, wherein said plurality of charge storage capacitor devices includes a first charge storage capacitor device and a second charge storage capacitor device; and wherein said corresponding plurality of sets of ignition outputs includes a first set of ignition outputs each operatively coupled to said first storage capacitor device and a second set of ignition outputs each operatively coupled to said second storage capacitor device.

20. The capacitive discharge ignition system as defined in claim 19, wherein said at least one charging circuit includes a first charging circuit provided for charging said first charge storage capacitor device and a second charging circuit provided for charging said second charge storage capacitor device.

21. The capacitive discharge ignition system as defined in claim 19, wherein said at least one charging circuit includes a single charging circuit provided for charging both said first charge storage capacitor device and said second charge storage capacitor device.

* * * * *